US010130983B2

(12) United States Patent
McNurlin et al.

(10) Patent No.: US 10,130,983 B2
(45) Date of Patent: Nov. 20, 2018

(54) BENDER CART

(71) Applicant: Southwire Company, LLC, Carrollton, GA (US)

(72) Inventors: Randy McNurlin, Phoenix, AZ (US); Timmothy Bardin, Carrollton, GA (US)

(73) Assignee: SOUTHWIRE COMPANY, LLC, Carrollton, GA (US)

( * ) Notice: Subject to any disclaimer, the term of this patent is extended or adjusted under 35 U.S.C. 154(b) by 0 days.

(21) Appl. No.: 15/283,693

(22) Filed: Oct. 3, 2016

(65) Prior Publication Data

US 2017/0095850 A1 Apr. 6, 2017

Related U.S. Application Data

(60) Provisional application No. 62/236,669, filed on Oct. 2, 2015.

(51) Int. Cl.

| | |
|---|---|
| ***B21D 7/00*** | (2006.01) |
| ***B21D 7/16*** | (2006.01) |
| ***B21D 7/02*** | (2006.01) |
| *B21D 7/024* | (2006.01) |

(52) U.S. Cl.

CPC ..... *B21D 7/16* (2013.01); *B21D 7/00* (2013.01); *B21D 7/02* (2013.01); *B21D 7/021* (2013.01); *B21D 7/024* (2013.01)

(58) Field of Classification Search

CPC ..... B21D 7/02; B21D 7/021; B21D 7/022; B21D 7/024; B23Q 3/04; B23Q 3/10; B23Q 3/105; B23Q 3/106; B23Q 3/18; B23Q 2003/15531; B23Q 2003/1553

See application file for complete search history.

(56) References Cited

U.S. PATENT DOCUMENTS

| | | | | |
|---|---|---|---|---|
| 4,485,658 A * | 12/1984 | Stewart | ..... | B21D 7/021 72/149 |
| 4,546,632 A * | 10/1985 | Van Den Kieboom | ..... | B21D 7/022 492/1 |
| 5,499,521 A * | 3/1996 | Luikart | ..... | B21D 7/024 72/149 |
| 9,283,605 B2 | 3/2016 | Plummer et al. | | |
| 2011/0271735 A1 | 11/2011 | Plummer et al. | | |

* cited by examiner

*Primary Examiner* — Debra Sullivan
(74) *Attorney, Agent, or Firm* — Merchant & Gould P.C.

(57) ABSTRACT

A power bender may be provided. The power bender may comprise a cart, a bender mechanism, and a scissor mechanism. The cart may have a zero turn radius. The bender mechanism may be configured to bend conduit. The scissor mechanism may be disposed between the cart and the bender mechanism. The scissor mechanism may be configured adjust a working height of the bender mechanism above the cart. The bender mechanism may be configured to rotate about a pivot point.

20 Claims, 18 Drawing Sheets

BENDER CART

RELATED APPLICATIONS

Under provisions of 35 U.S.C. § 119(e), Applicants claim the benefit of U.S. provisional application No. 62/236,669 filed Oct. 2, 2015, which is incorporated herein by reference.

BACKGROUND

An electrical conduit is a tube used to protect and route electrical wiring in a building or non-building structure. Electrical conduit may be made of metal, plastic, fiber, or fired clay. Most conduit is rigid, but flexible conduit is used for some purposes. Conduit is generally installed by electricians at the site of installation of electrical equipment. Its use, form, and installation details are often specified by wiring regulations, such as the US National Electrical Code (NEC) and other building codes.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1A:
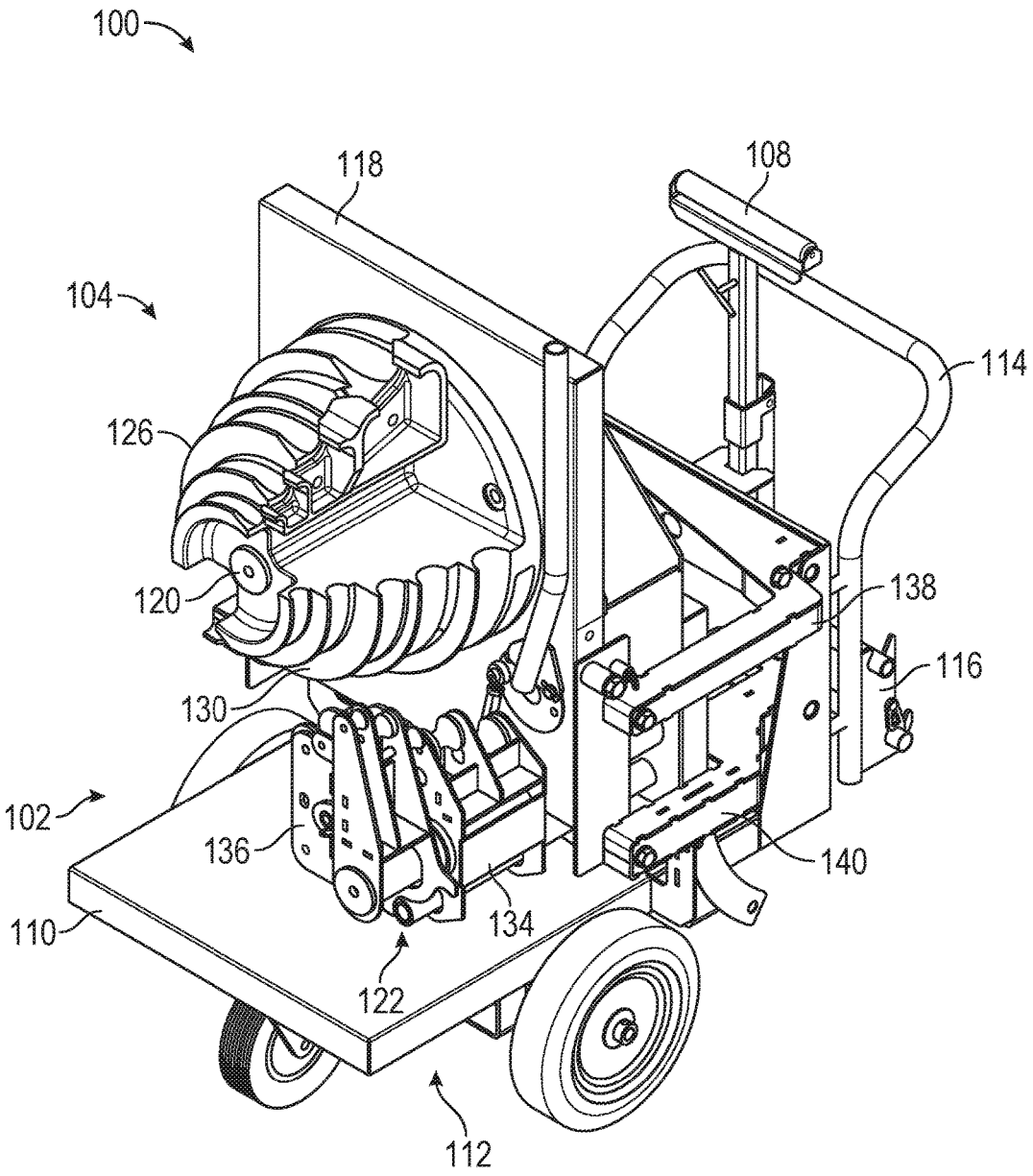
FIG. 1A, FIG. 1B, FIG. 1C, and FIG. 1D show a power bender.
Figure 1B:
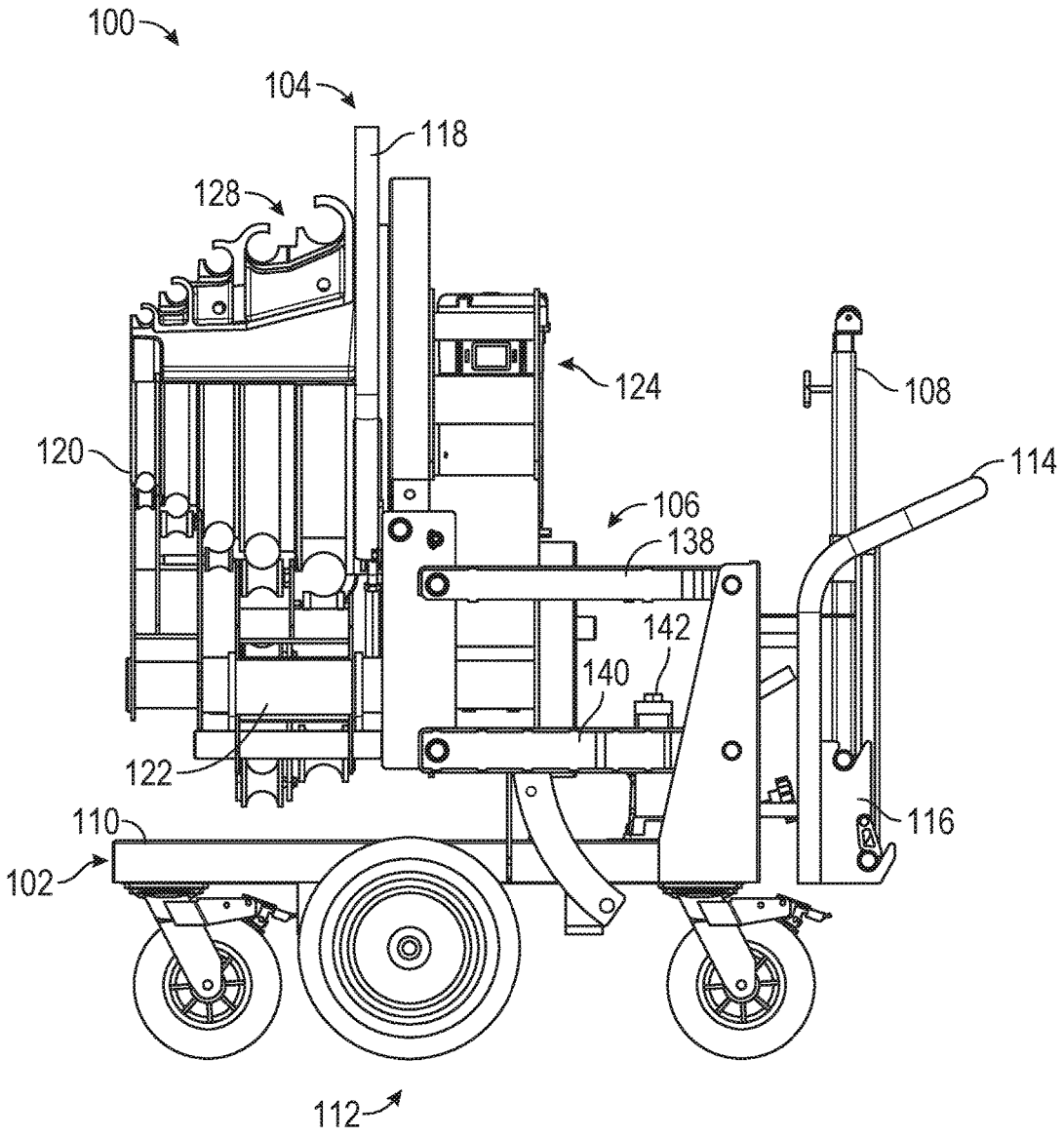
Figure 1C:
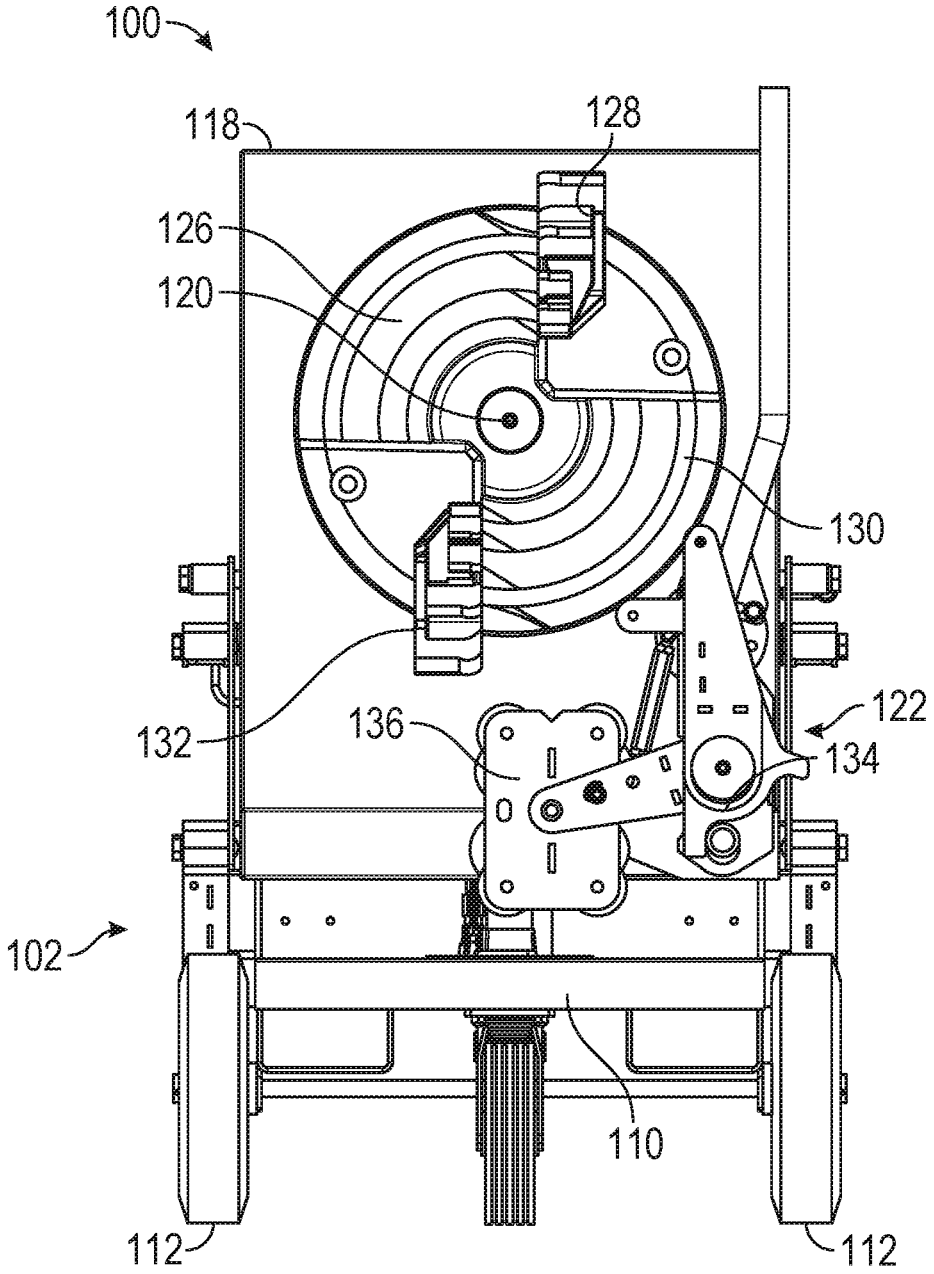
Figure 1D:
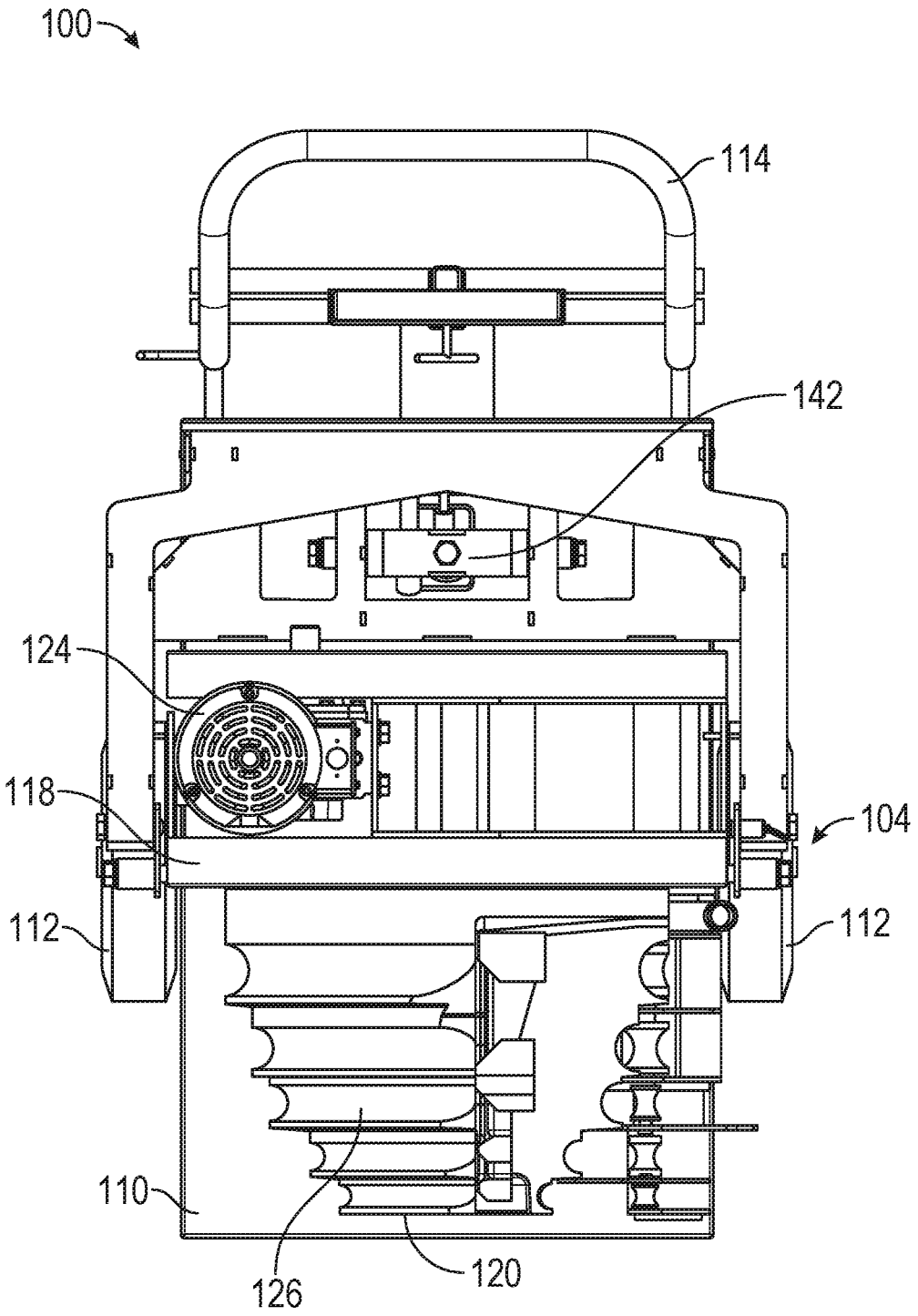

A power bender may be provided. The power bender may comprise a cart, a bender mechanism, and a scissor mechanism. The cart may have a zero turn radius. The bender mechanism may be configured to bend conduit. The scissor mechanism may be disposed between the cart and the bender mechanism. The scissor mechanism may be configured adjust a working height of the bender mechanism above the cart. The bender mechanism may be configured to rotate about a pivot point.

Both the foregoing overview and the following example embodiment are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiment.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Embodiments of the disclosure may comprise a power bender for ¾ inch to 2 inch Rigid, intermediate metal conduit (IMC), or and electrical metallic tubing (EMT) conduit for example. Utilizing a jacking mechanism built into a frame of a power bender platform, the height may be adjusted to accommodate many different working levels (e.g., heights). These many different working levels may provide a more ergonomic working height and may be adjusted to comfortably fit all end users (e.g., operators). Embodiments of the disclosure may allow for pivoting and locking a bender mechanism to allow for bending on both a vertical and horizontal plane.

The power bender, consistent with embodiments of the disclosure, may include a cart with wheels placed in a fashion that allows the cart to turn on a zero degree radius. This may allow for easy maneuvering in tight and confined spaces. Embodiments of the disclosure may include a roller assembly that may have a centralized locking mechanism combined with elastomeric rollers that may provide a bend quality that may remain consistent with different variations in conduit materials.

FIG. 1A, FIG. 1B, FIG. 1C, and FIG. 1D show a power bender 100 in accordance with embodiments of the disclosure. As shown in FIG. 1A, FIG. 1B, FIG. 1C, and FIG. 1D, power bender 100 may comprise a cart 102, a bender mechanism 104, a jacking mechanism (e.g. a scissor mechanism 106), and a conduit roller support 108. Cart 102 may comprise a platform 110, wheels 112, a handle 114, and a conduit roller support storage compartment 116. Conduit roller support 108 may be detached from cart 102 for use as described below (e.g., FIG. 9) and may be reattached to cart 102 in conduit roller support storage compartment 116 for storage. Cart 102 may be configured to have a turning radius that is effectively zero.

Bender mechanism 104 may comprise a support deck 118, a bending shoe 120, a head unit 122, and a power mechanism 124. Bending shoe 120 may comprise a first plurality of channels 126, a first plurality of hooks 128, a second plurality of channels 130, and a second plurality of hooks 132. An operator may choose between using first plurality of channels 126 or second plurality of channels 130 based upon the type of conduit being bent. For example, first plurality of channels 126 and first plurality of hooks 128 may be used when bending EMT and second plurality of channels 130 and a second plurality of hooks 132 may be used when bending rigid conduit or IMC. Ones within first plurality of channels 126 and within second plurality of channels 130 may be selected based on the size of conduit being bent. For example, a first one of first plurality of channels 126 and a first one of second plurality of channels 130 may be used for 2 inch conduit and a second one of first plurality of channels 126 and a second one of second plurality of channels 130 may be used for 1½ inch conduit. Head unit 122 may comprise a locking mechanism 134 and a rollers assembly 136. Scissor mechanism 106 may comprise an upper arm 138, a lower arm 140, and a jack 142.

Figure 2A:
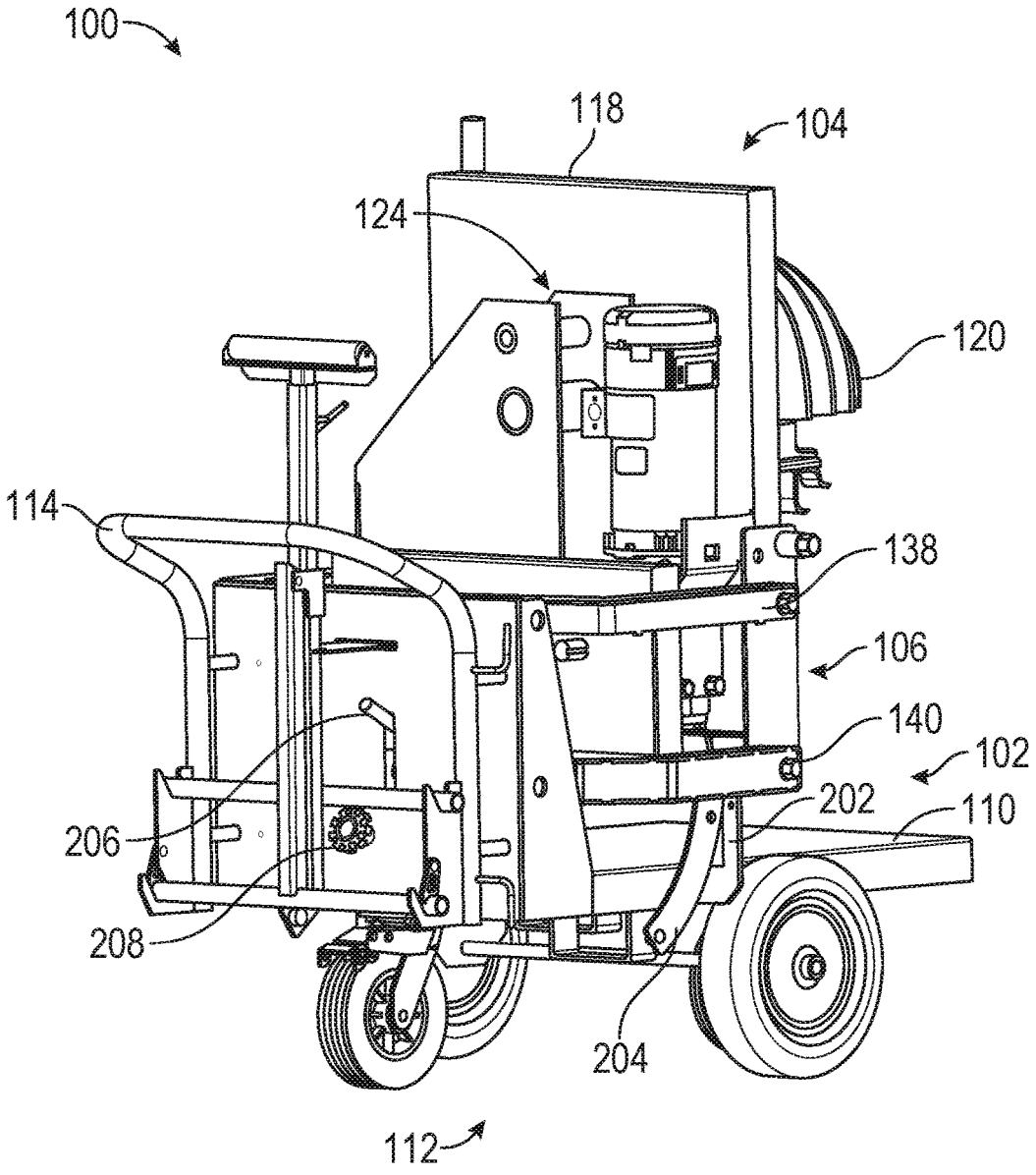
FIG. 2A and FIG. 2B show a power bender.
Figure 2B:
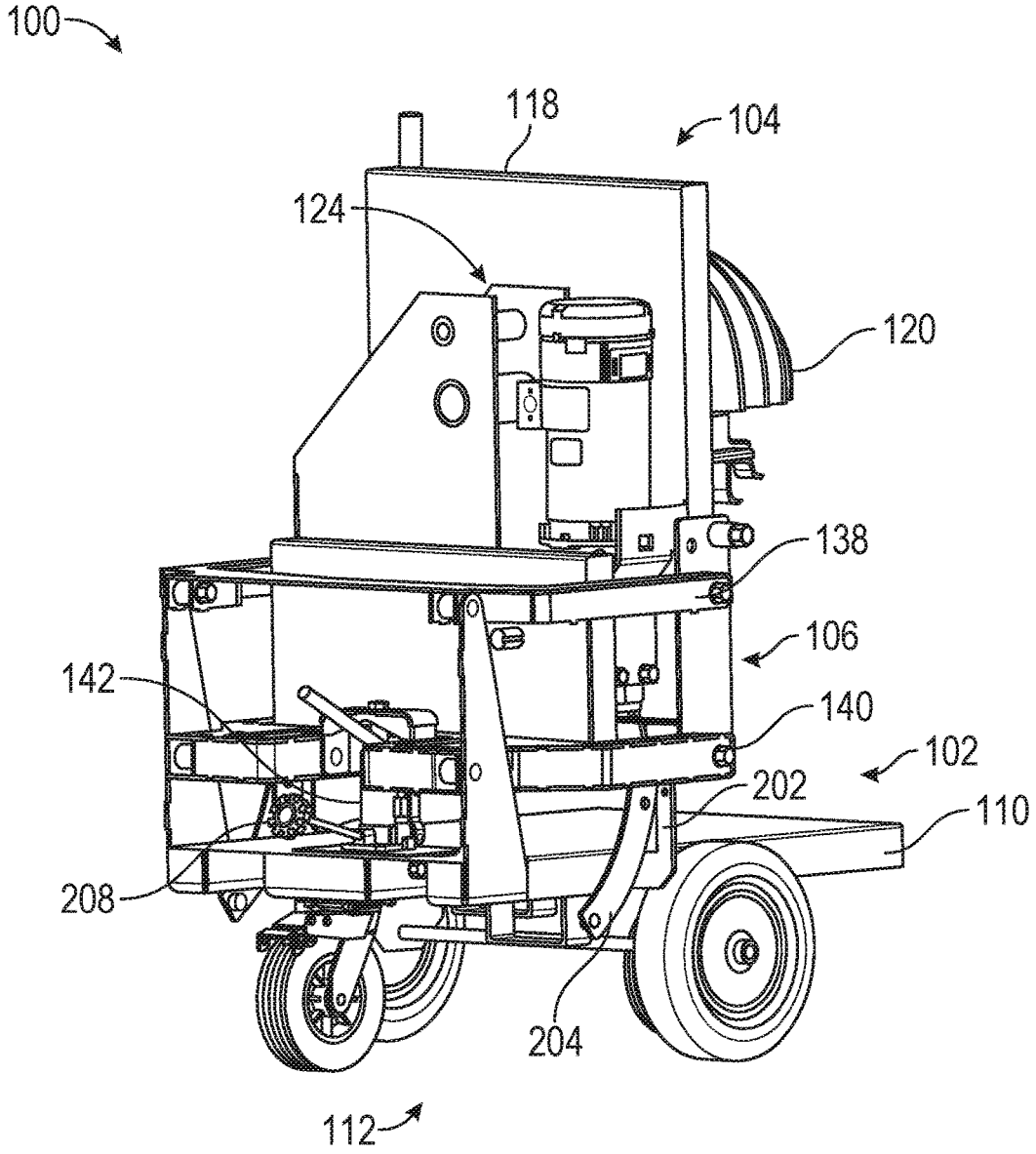

FIG. 2A and FIG. 2B show power bender 100 in accordance with embodiments of the disclosure. As shown in FIG. 2A and FIG. 2B, scissor mechanism 106 may comprise a bottom travel stop 202, a top travel stop 204, a pump handle 206, and a relief handle 208. Jack 142 may comprise, but is not limited to, a two ton bottle jack. Pump handle 206 may be used to raise jack 142 and relief handle 208 may be used to lower jack 142. A foot actuated mechanism may be used raise jack 142 as described below with respect to FIG. 9.

Figure 3A:
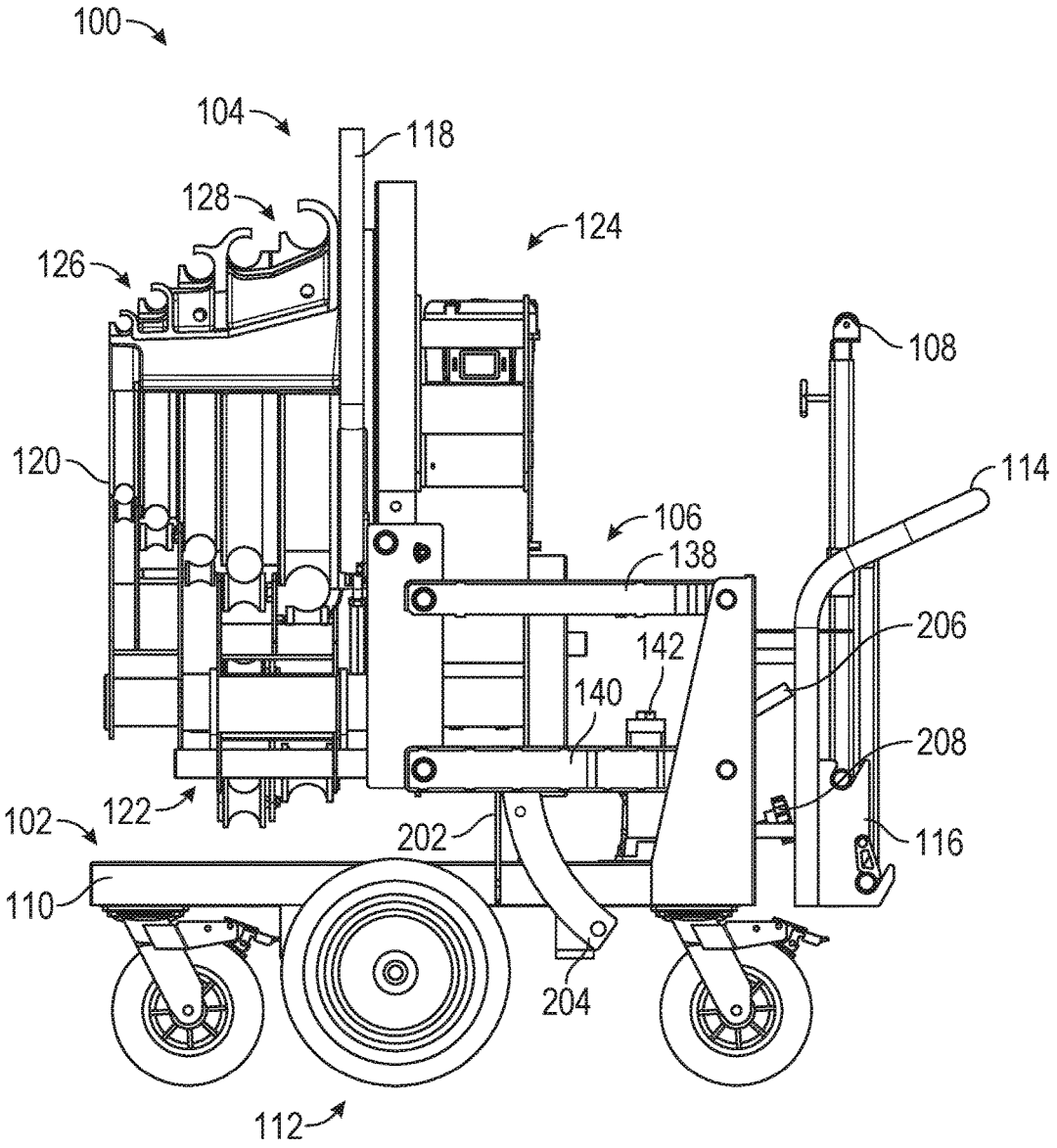
FIG. 3A and FIG. 3B show a power bender.
Figure 3B:
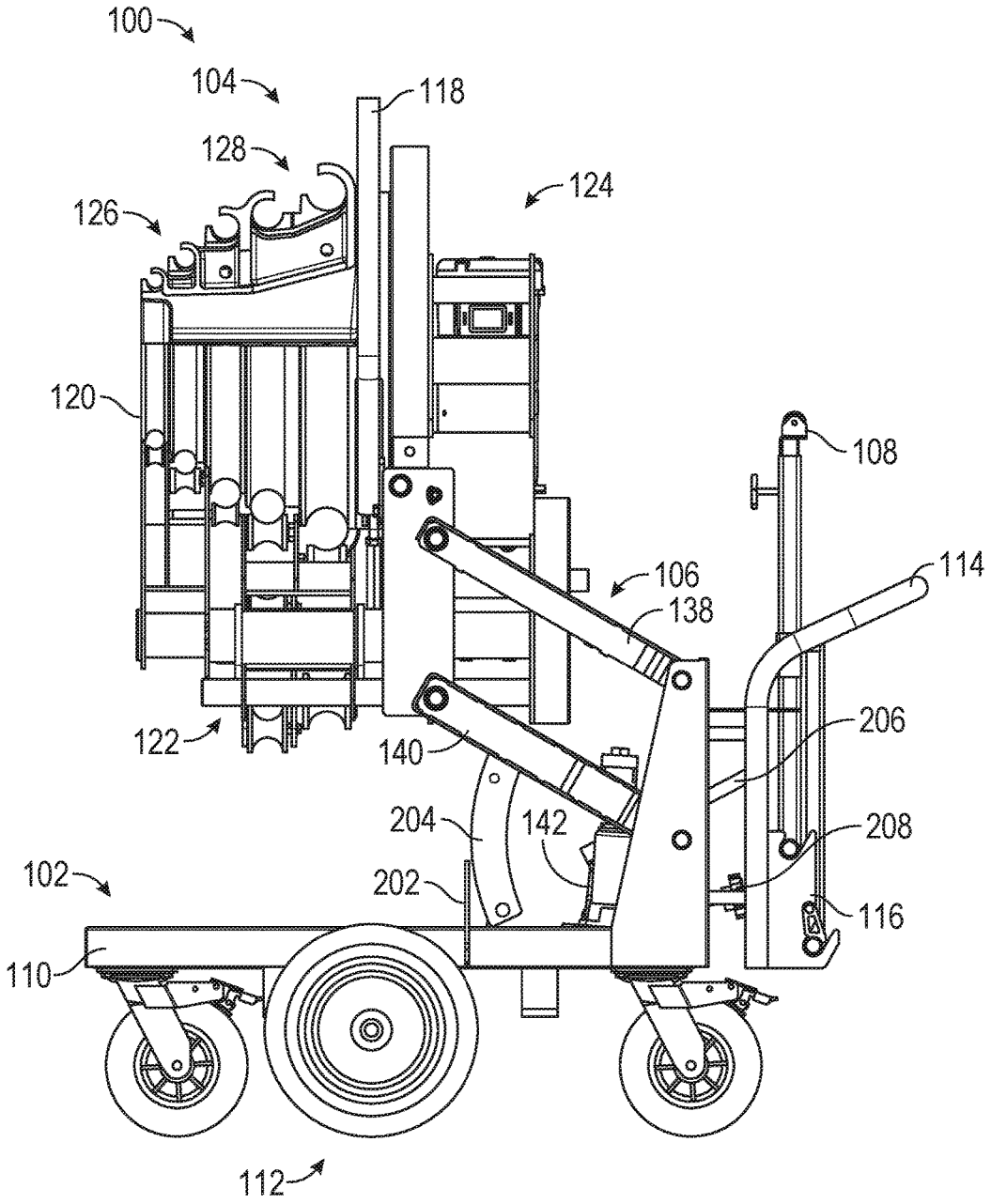

FIG. 3A and FIG. 3B show power bender 100 in accordance with embodiments of the disclosure. As shown in FIG. 3A and FIG. 3B, scissor mechanism 106 may raise and lower bender mechanism 104 while bender mechanism 104 is in a vertical working position. FIG. 3A shows scissor mechanism 106 lowering bender mechanism 104 to its lowest position. FIG. 3B shows scissor mechanism 106 raising bender mechanism 104 to its highest position. Scissor mechanism 106 may raise or lower bender mechanism 104 to any position between its highest position (e.g., as shown in FIG. 3B) and its lowest position (e.g., as shown in FIG. 3A). While embodiments of the disclosure show that scissor mechanism 106 may be used to raise and lower bender mechanism 104, any type of a jacking mechanism may be used as described above consistent with embodiment of the disclosure.

An operator may desire to raise or lower bender mechanism 104 to provide a certain working position for bender mechanism 104 based, for example, on a requirement of the job being worked or based or the height of the operator. In order to do so, the operator may actuate pump handle 206 (or foot actuated mechanism) to raise bender mechanism 104 to the desire working height or the operator may actuate relief handle 208 to lower bender mechanism 104 to the desire working height. By actuating pump handle 206 (or foot actuated mechanism) and relief handle 208, the operator may cause jack 142 to apply a force to lower arm 140 to maintain the desired working height. Upper arm 138 may move in parallel with lower arm 140 to keep bender mechanism 104 from rotating for example. Bottom travel stop 202 may define the bottom of scissor mechanism 106's travel and thus the lowest position for the working height of bender mechanism 104. And top travel stop 204 may define the top of scissor mechanism 106's travel and thus the highest position for the working height of bender mechanism 104.

Figure 4A:
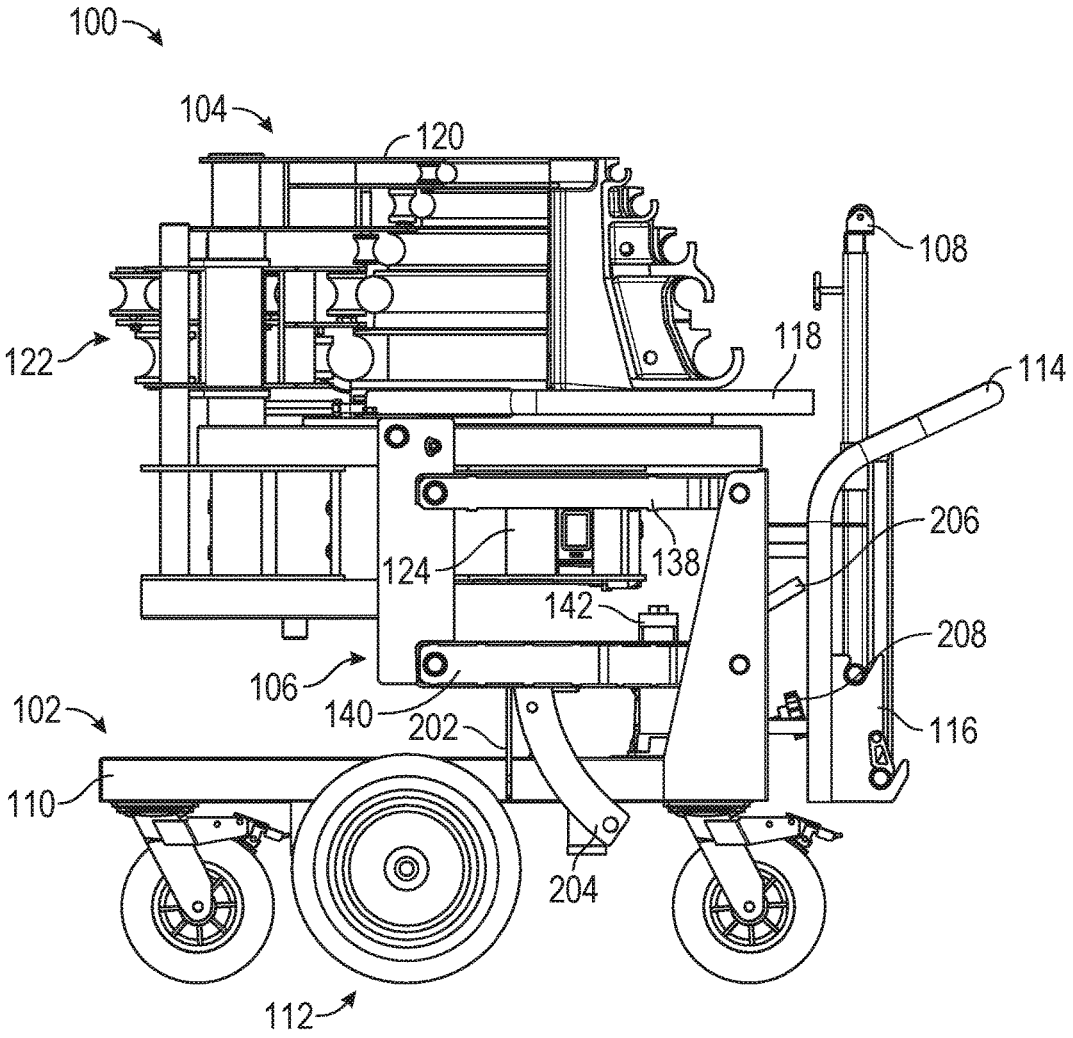
FIG. 4A and FIG. 4B show a power bender.
Figure 4B:
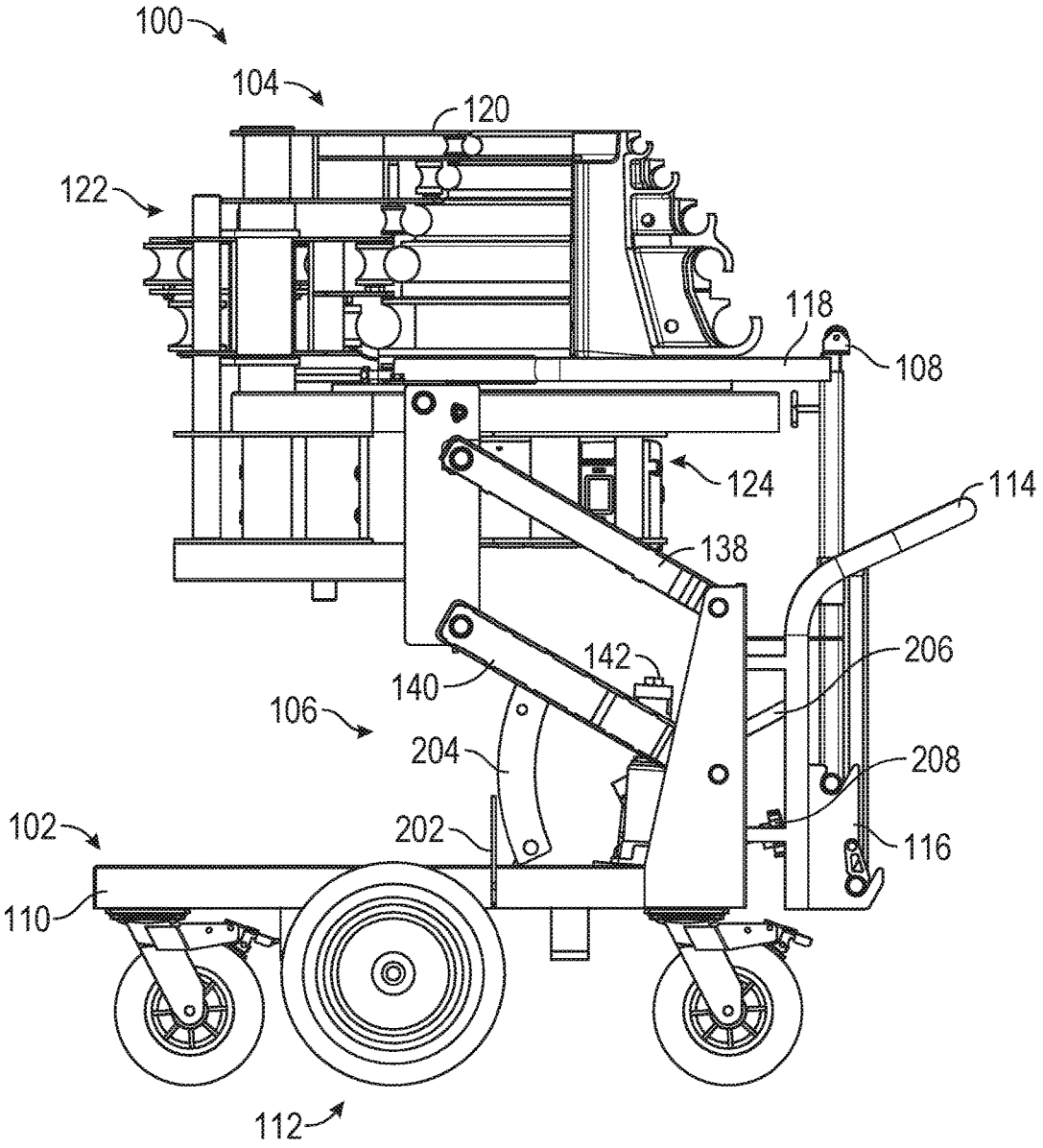

FIG. 4A and FIG. 4B show power bender 100 in accordance with embodiments of the disclosure. As shown in FIG. 4A and FIG. 4B, scissor mechanism 106 may raise and lower bender mechanism 104 while bender mechanism 104 is in a horizontal working position. At any point, bender mechanism 104 may be rotated from a horizontal working position (FIG. 4A and FIG. 4B) to a vertical working position (FIG. 3A and FIG. 3B) or from a vertical working position (FIG. 3A and FIG. 3B) to a horizontal working position (FIG. 4A and FIG. 4B). Bender mechanism 104 may be rotated when it is fully raised (FIG. 3B and FIG. 4B), fully lowered (FIG. 3A and FIG. 4A), or while at any level in between fully raised and fully lowered.

Figure 5A:
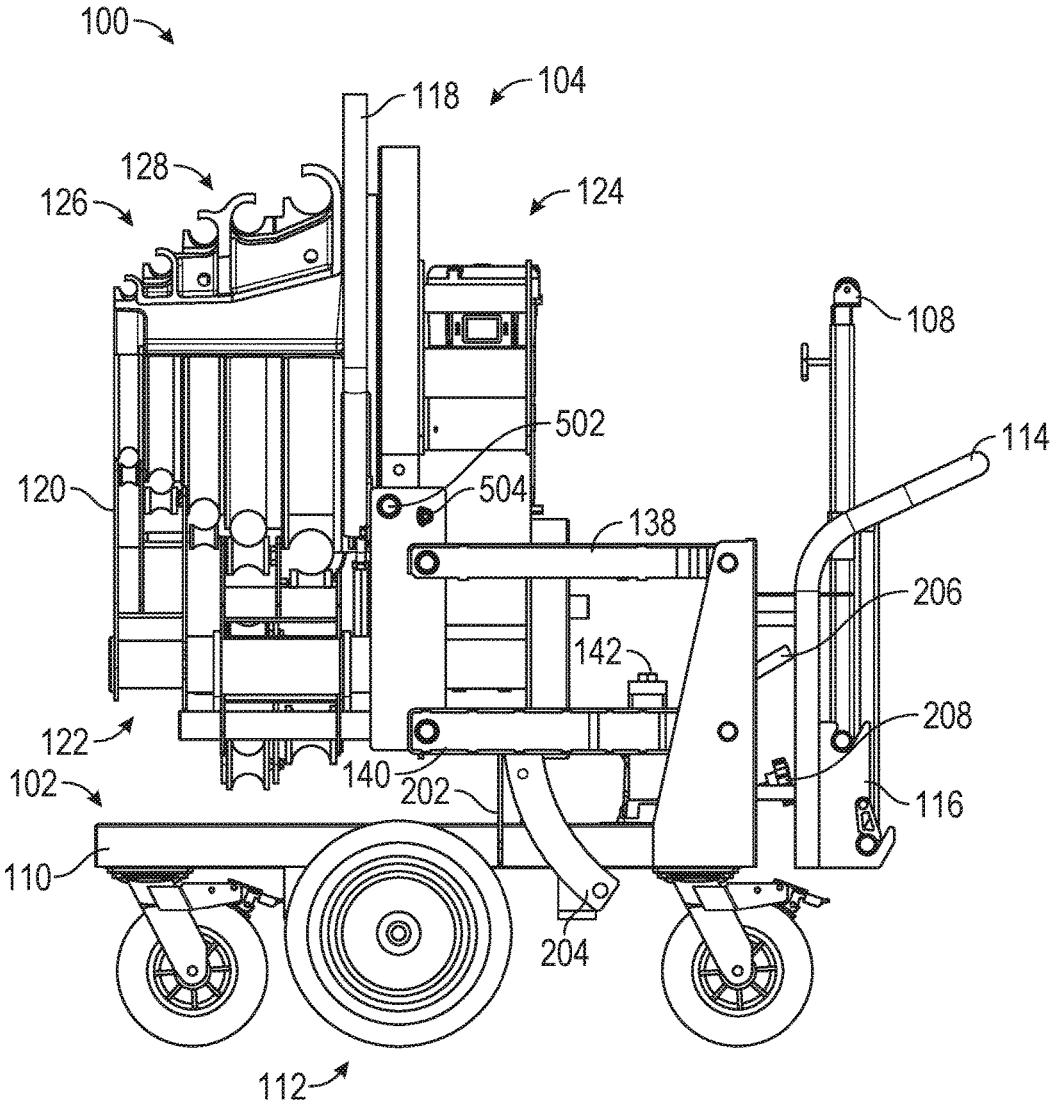
FIG. 5A and FIG. 5B show a power bender.
Figure 5B:
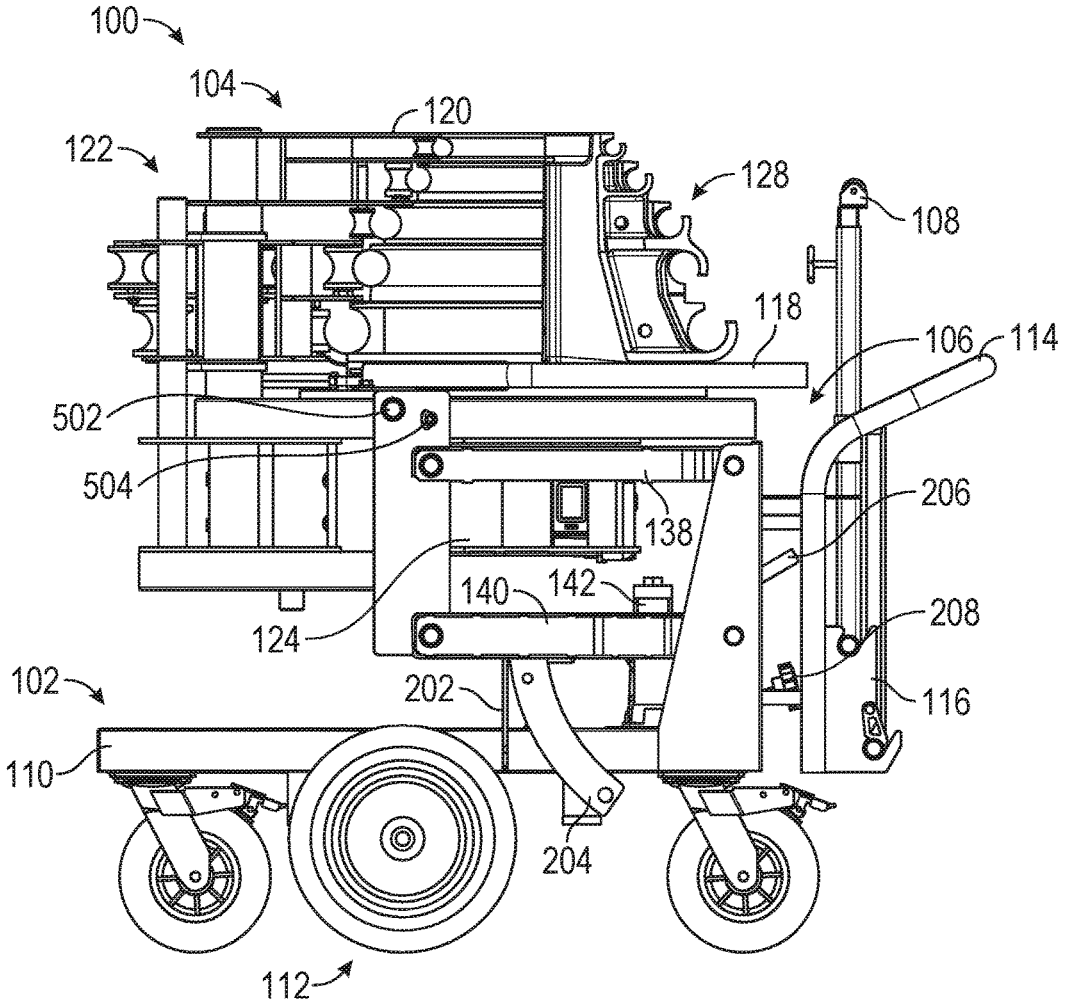

FIG. 5A and FIG. 5B show power bender 100 in accordance with embodiments of the disclosure. As shown in FIG. 5A and FIG. 5B, bender mechanism 104 may be rotated about a pivot point 502 and locked into place by pin 504. Pivot point 502 may be located near the center of gravity for bender mechanism 104. Bender mechanism 104 may be rotated about pivot point 502 from a horizontal working position to a vertical working position and then locked into place by pin 504. Bender mechanism 104 may be rotated about pivot point 502 from a vertical working position to a horizontal working position and then locked into place by pin 504.

Figure 6:
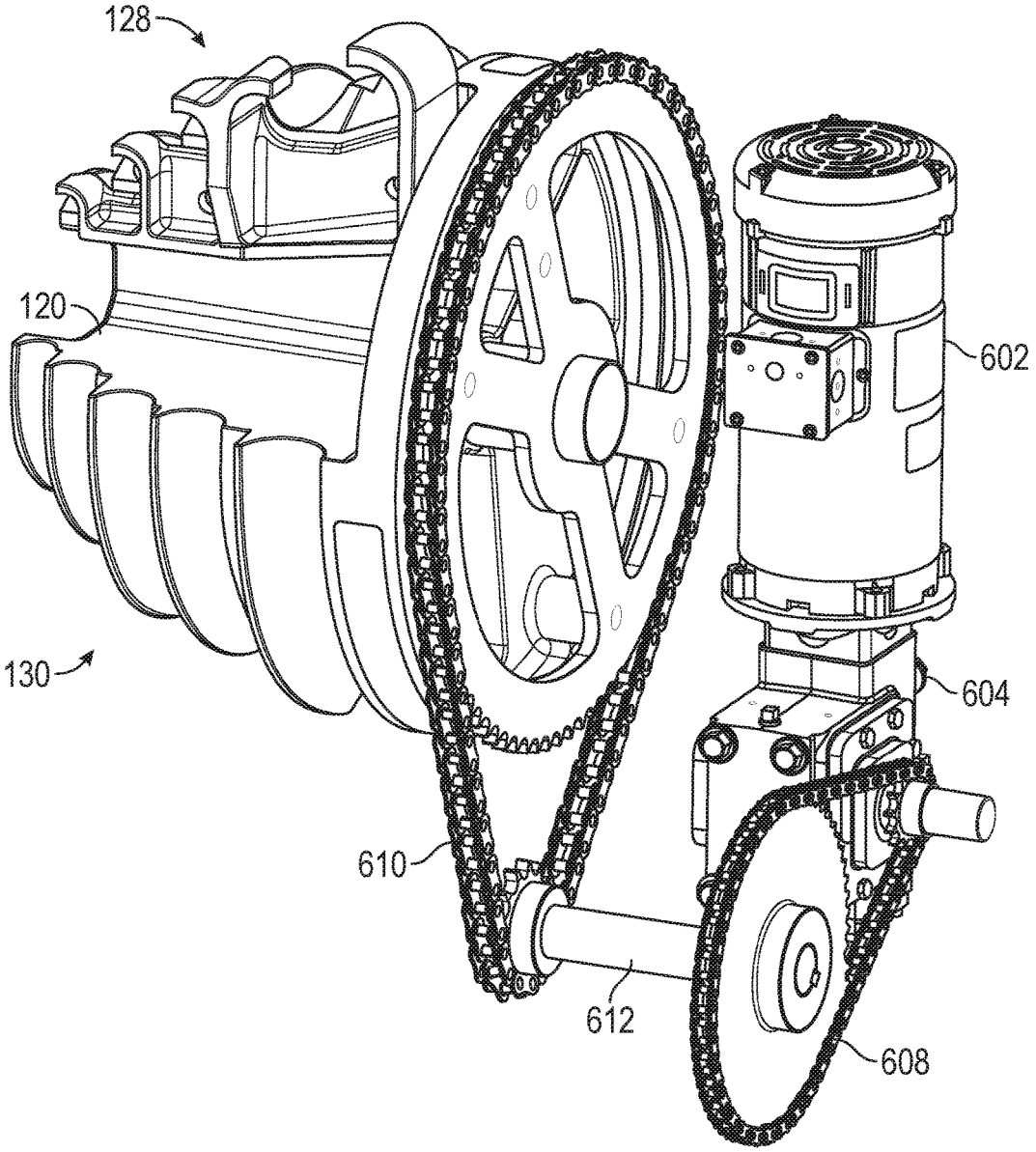
FIG. 6 shows a power mechanism.

FIG. 6 shows power mechanism 124 in accordance with embodiments of the disclosure. As shown in FIG. 6B, power mechanism 124 may comprise a motor 602, a gearbox 604, a first chain 608, a second chain 610, and a shaft 612. Motor 602 may comprise, but is not limited to a 1750 RPM DC motor. Gearbox 604 may comprise, but is not limited to, a 60:1 primary drive reduction gearbox. First chain 608 may comprise a No. 40 chain and may cause a 60:1 secondary drive reduction. Second chain 610 may comprise a No. 60 chair and may cause an 80:1 tertiary drive reduction. Motor 602 may cause bending shoe 120 to rotate and bend a conduit.

Figure 7A:
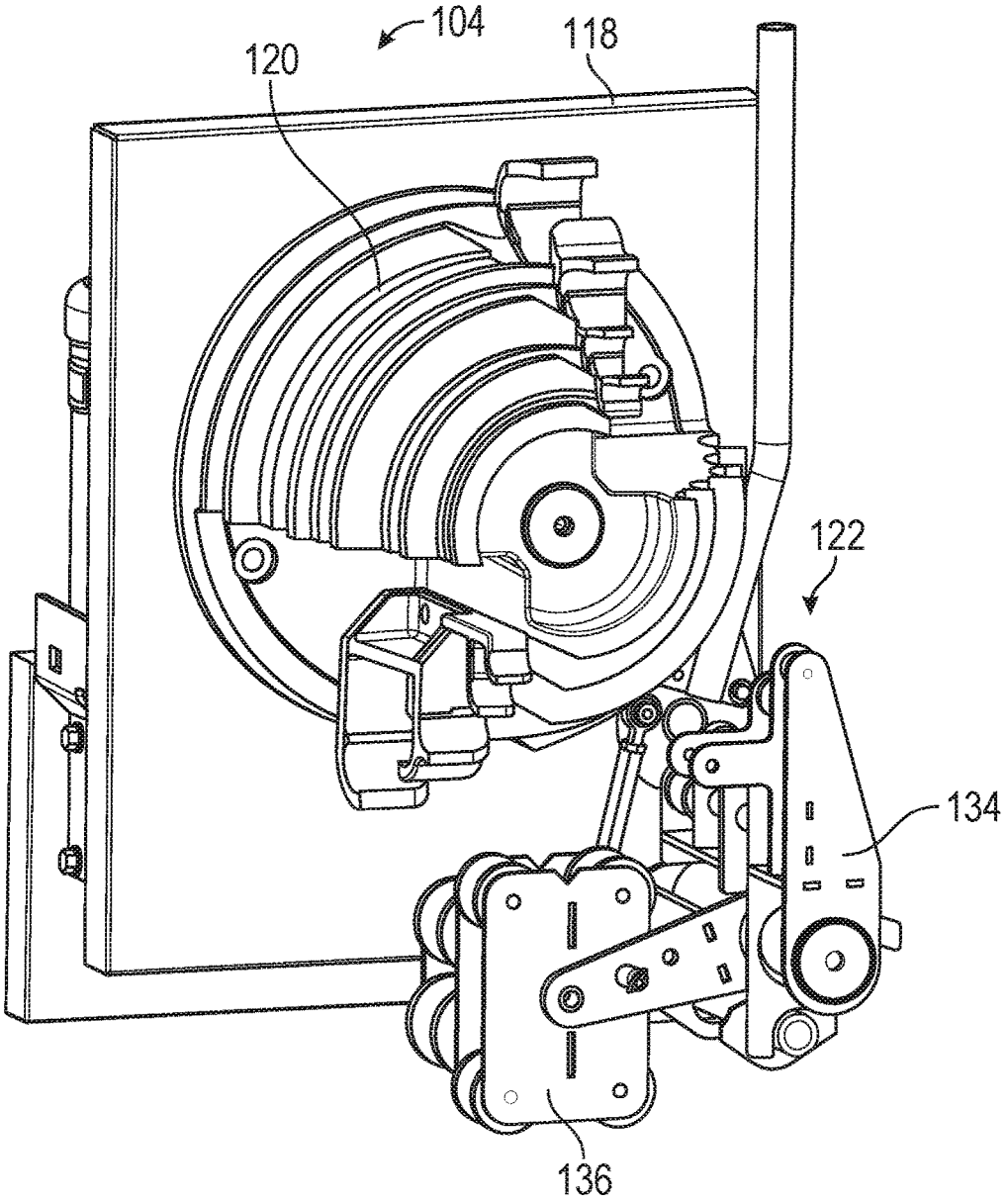
FIG. 7A and FIG. 7B show a bending shoe and a head unit.
Figure 7B:
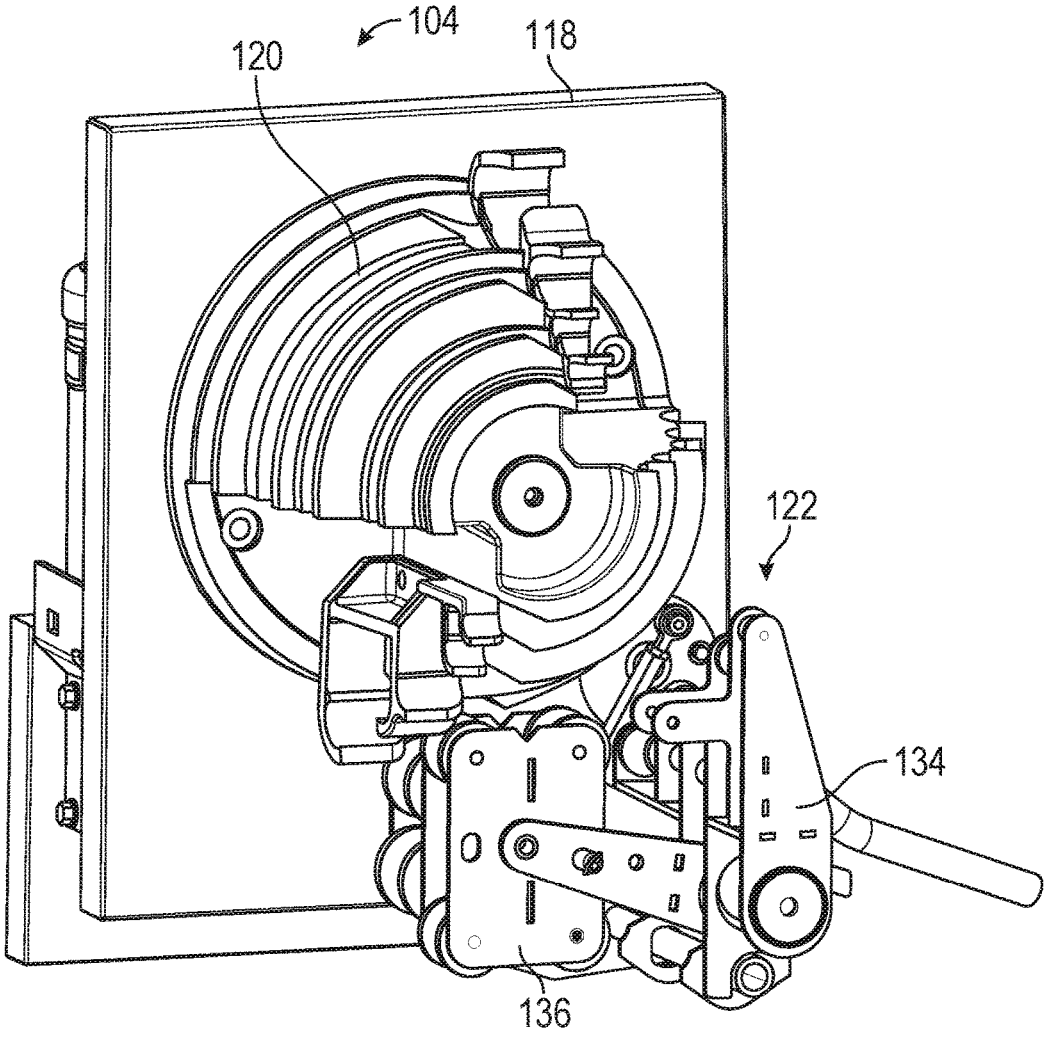

FIG. 7A and FIG. 7B show bending shoe 120 and head unit 122 in accordance with embodiments of the disclosure. As shown in FIG. 7A, locking mechanism 134 may be in an unlocked position with rollers assembly 136 away from bending shoe 120. While in the configuration shown in FIG. 7A, a conduit (not shown) may be loaded into shoe 120 by placing the conduit into one of first plurality of channels 126 or one of second plurality of channels 130 and hooking the conduit into place by one of first plurality of hooks 128 or one of second plurality of hooks 132 respectively. After the conduit is loaded, locking mechanism 134 may be changed from the unlocked position to the locked position with rollers assembly 136 toward bending shoe 120 causing the conduit to be held snuggly between rollers assembly 136 and bending shoe 120 as shown in FIG. 7B.

Figure 8A:
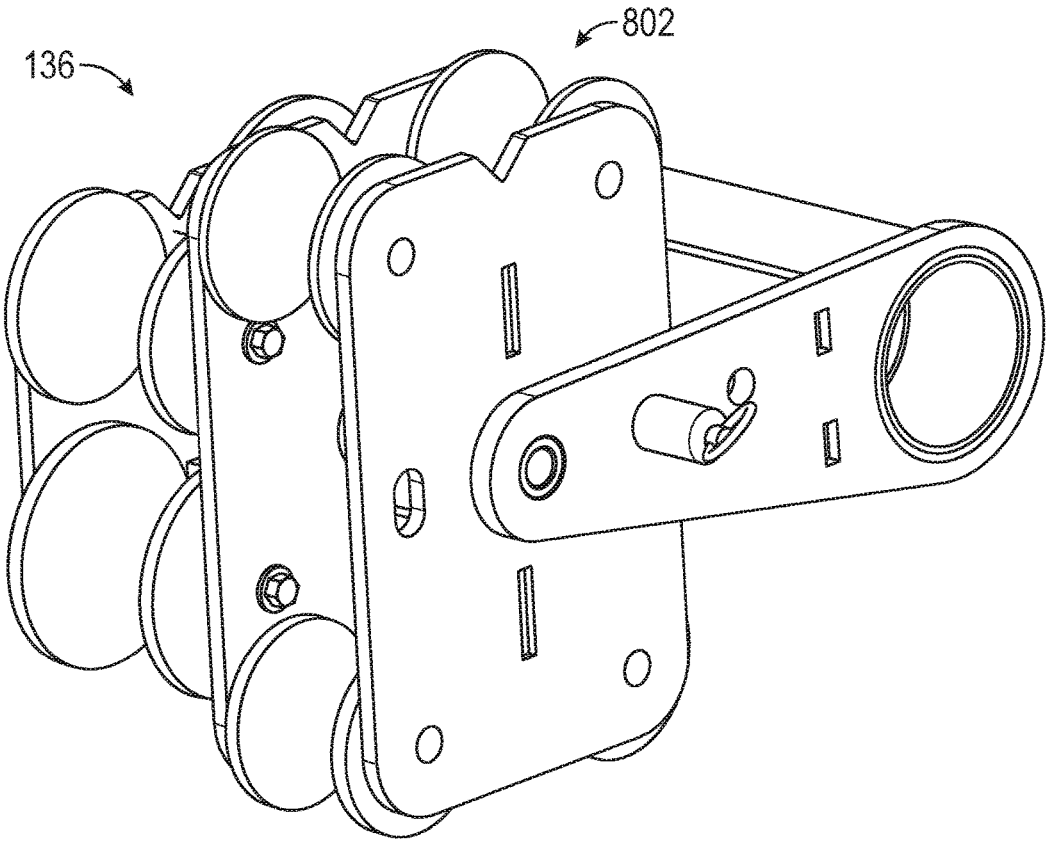
FIG. 8A and FIG. 8B show rollers assembly.
Figure 8B:
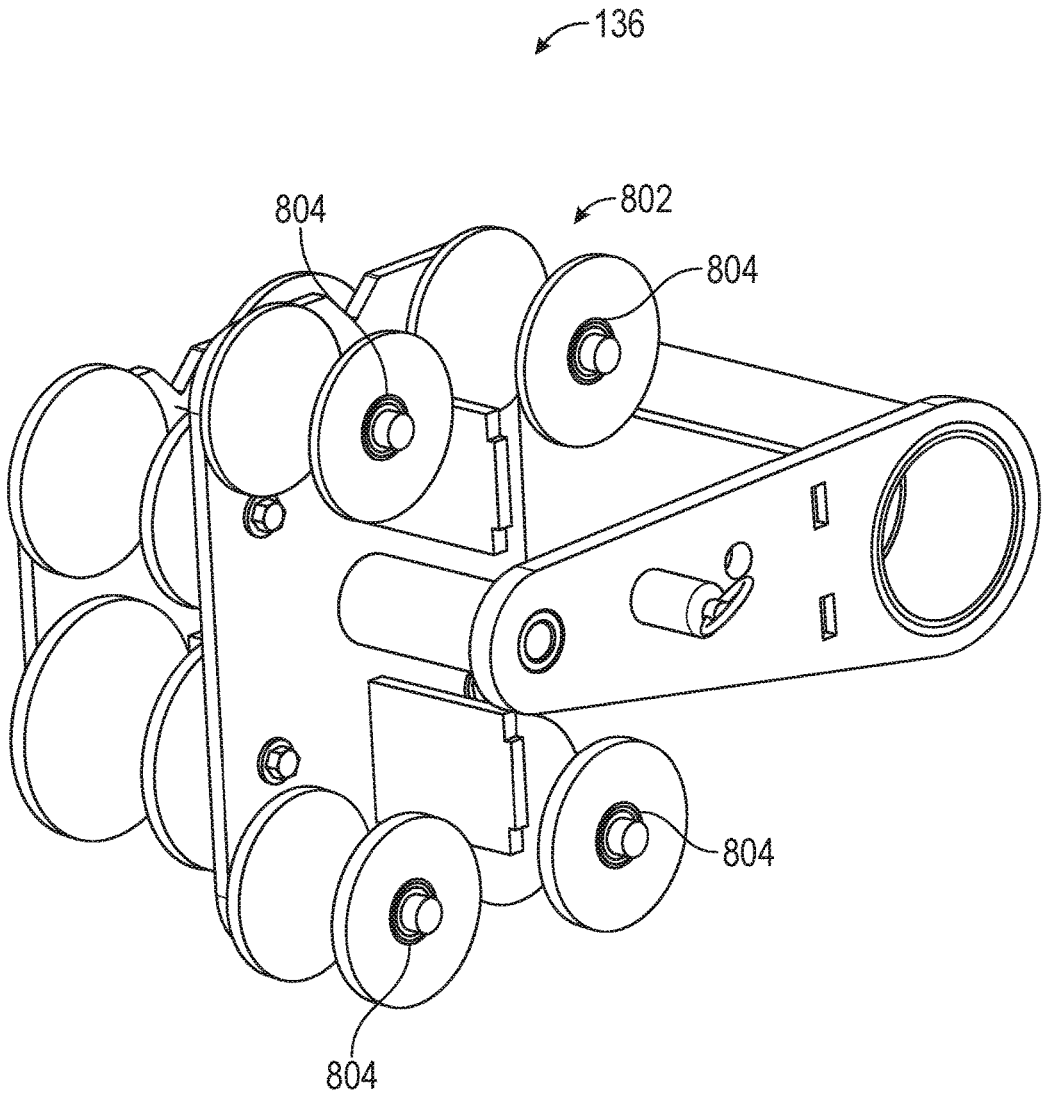

FIG. 8A and FIG. 8B show rollers assembly 136 in accordance with embodiments of the disclosure. FIG. 8A shows rollers assembly 136 with a front plate on and FIG. 8B shows rollers assembly 136 with the front plate off. As shown in FIG. 8B, rollers assembly 136 may comprise a plurality of rollers 802, each of which may have a corresponding core 804. Core 804 may comprise an elastomer material. Core 804 may provide some "give" when the conduit is held snuggly between rollers assembly 136 and bending shoe 120. This "give" may provide a conduit bending quality that may remain consistent with variations in conduit material variances.

Figure 9:
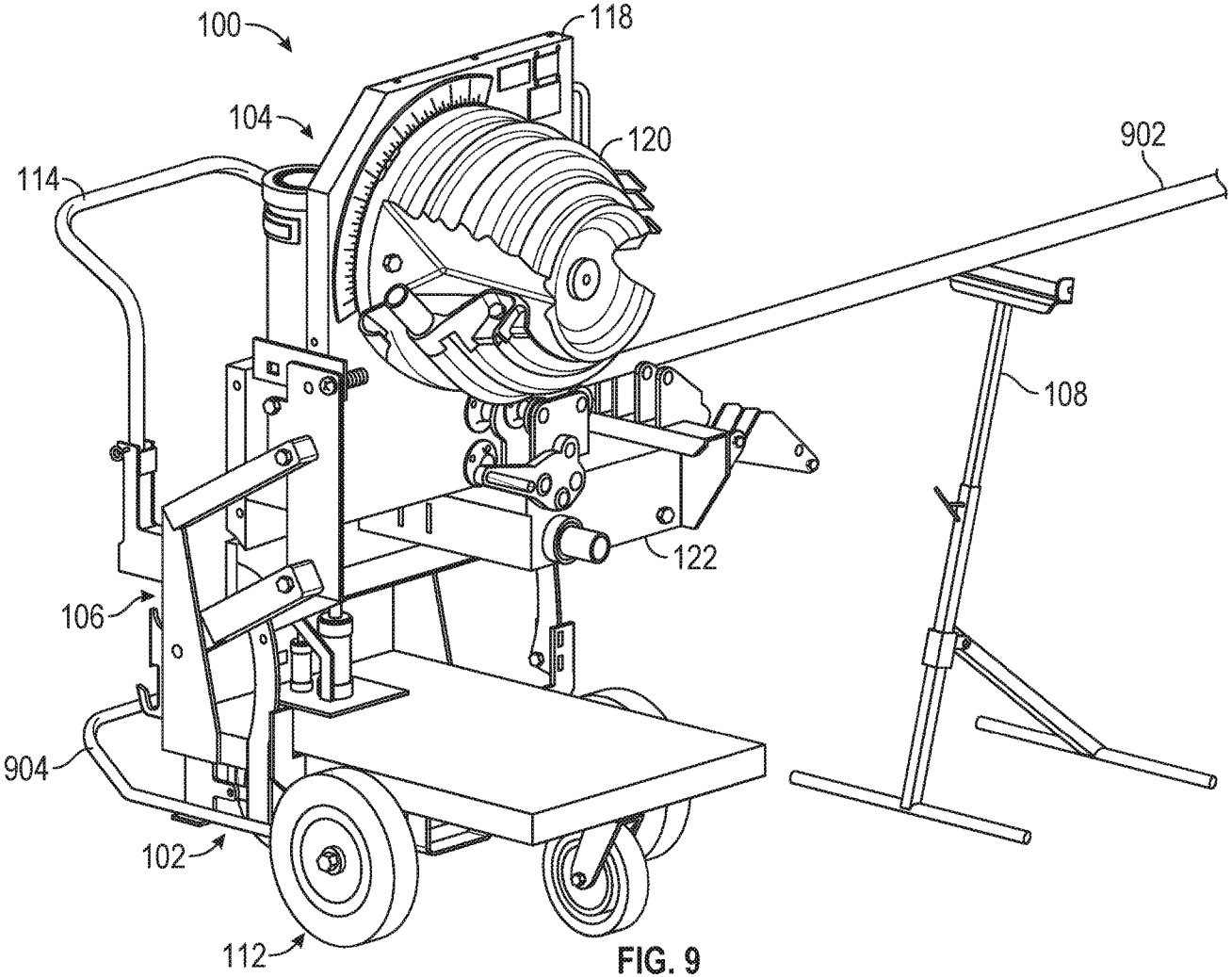
FIG. 9 shows power bender.

FIG. 9 shows power bender 100 in accordance with embodiments of the disclosure. As shown in FIG. 9, bender mechanism 104 may be raised and rotated to a desired height and orientation (e.g., horizontal or vertical). The embodiment shown in FIG. 9 may include a pump foot handle 904 that may comprise a foot actuated mechanism that may be used to raise jack 142 as described above. Conduit roller support 108 may be detached from cart 102 and set up to support a conduit 902. Conduit 902 may be loaded into shoe 120 by placing conduit 902 into one of first plurality of channels 126 or one of second plurality of channels 130 and hooking conduit 902 into place by one of first plurality of hooks 128 or one of second plurality of hooks 132 respectively. After conduit 902 is loaded, locking mechanism 134 may be changed from the unlocked position to the locked position with rollers assembly 136 toward bending shoe 120 and conduit 902 being held snuggly between rollers assembly 136 and bending shoe 120. Power mechanism 124 may then be engaged to rotate bending shoe 120 and thus bend conduit 902.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. An apparatus comprising:

a cart having wheels wherein a wheel axis passes through the center of the wheels;

a bender mechanism configured to bend conduit wherein the bender mechanism is configured to rotate about a pivot point wherein a pivot point axis passes through the pivot point, the wheel axis and the pivot point axis being substantially parallel; and a jacking mechanism disposed between the cart and the bender mechanism, the jacking mechanism configured to adjust a working height of the bender mechanism above the cart, the jacking mechanism configured adjust a distance between the wheel axis and the pivot point axis, the jacking mechanism comprising an upper arm and a lower arm pivotally extending in parallel between the cart and the bender mechanism.

2. The apparatus of claim 1, wherein the bender mechanism is configured to rotate about the pivot point axis from a vertical working position to a horizontal working position.

3. The apparatus of claim 1, wherein the bender mechanism is configured to rotate about the pivot point axis from a horizontal working position to a vertical working position.

4. The apparatus of claim 1, wherein the bender mechanism is configured to rotate about the pivot point axis when the bender mechanism is fully raised.

5. The apparatus of claim 1, wherein the bender mechanism is configured to rotate about the pivot point axis when the bender mechanism is fully lowered.

6. The apparatus of claim 1, wherein the bender mechanism is configured to rotate about the pivot point axis when the bender mechanism is between a fully lowered position and a fully raised position.

7. The apparatus of claim 1, wherein the cart has a zero turn radius.

8. The apparatus of claim 1, wherein the bender mechanism is configured to bend the conduit comprising a diameter between ¾ inch and 2 inch conduit inclusively.

9. The apparatus of claim 1, wherein the bender mechanism is configured to bend the conduit comprising one of the following: Rigid conduit, Intermediate Metal Conduit (IMC), and Electrical Metallic Tubing (EMT).

10. The apparatus of claim 1, wherein the jacking mechanism comprises a scissor mechanism.

11. The apparatus of claim 1, further comprising a conduit roller support.

12. The apparatus of claim 11, wherein the conduit roller support is detachable from the cart.

13. The apparatus of claim 1, further comprising a conduit roller support storage compartment.

14. The apparatus of claim 1, wherein the pivot point is located near a center of gravity for the bender mechanism.

15. An apparatus comprising:

a cart having wheels wherein a wheel axis passes through the center of the wheels;

a bender mechanism configured to bend conduit wherein the bender mechanism is configured to rotate about a pivot point wherein a pivot point axis passes through the pivot point, the wheel axis and the pivot point axis being substantially parallel; and a jacking mechanism, the jacking mechanism configured to adjust a working height of the bender mechanism, the jacking mechanism comprising an upper arm and a lower arm pivotally extending in parallel between the cart and the bender mechanism, the bender mechanism comprising;

a support deck, a bending shoe, a head unit, and a power mechanism.

16. The apparatus of claim 14, wherein the bending shoe comprises:

a first plurality of channels;

a first plurality of hooks;

a second plurality of channels; and a second plurality of hooks.

17. The apparatus of claim 14, wherein the power mechanism comprises:

a motor;

a gearbox;

a first chain;

a second chain; and a shaft.

18. An apparatus comprising:

a cart having wheels wherein a wheel axis passes through the center of the wheels;

a bender mechanism configured to bend conduit wherein the bender mechanism is configured to rotate about a pivot point wherein a pivot point axis passes through the pivot point, the wheel axis and the pivot point axis being substantially parallel;

a jacking mechanism disposed between the cart and the bender mechanism, the jacking mechanism configured to adjust a working height of the bender mechanism, the jacking mechanism comprising an upper arm and a lower arm pivotally extending in parallel between the cart and the bender mechanism, the bender mechanism comprising;

a support deck, a bending shoe, a head unit, and a power mechanism;

a conduit roller support detachable from the cart; and a conduit roller support storage compartment.

19. The apparatus of claim 18, wherein the bending shoe comprises:

a first plurality of channels;

a first plurality of hooks;

a second plurality of channels; and a second plurality of hooks.

20. The apparatus of claim 18, wherein the power mechanism comprises:

a motor;

a gearbox;

a first chain;

a second chain; and a shaft.

* * * * *